US012351277B2

(12) United States Patent
Jacobson

(10) Patent No.: US 12,351,277 B2
(45) **Date of Patent: *Jul. 8, 2025**

(54) STABILIZED FLOTATION PLATFORM

(71) Applicant: Rhonda Jacobson, Mesick, MI (US)

(72) Inventor: Rhonda Jacobson, Mesick, MI (US)

( * ) Notice: Subject to any disclaimer, the term of this patent is extended or adjusted under 35 U.S.C. 154(b) by 556 days.

This patent is subject to a terminal disclaimer.

(21) Appl. No.: 17/648,825

(22) Filed: Jan. 25, 2022

(65) Prior Publication Data

US 2023/0257077 A1 Aug. 17, 2023

(51) Int. Cl.
*B63B 22/24* (2006.01)
*B63B 35/44* (2006.01)

(52) U.S. Cl.
CPC ..... *B63B 22/24* (2013.01); *B63B 35/44* (2013.01)

(58) Field of Classification Search
CPC ..... B63B 34/00; B63B 34/22; B63B 34/52; B63B 34/565; B63B 35/44; B63B 34/58; B63B 22/24
USPC ..... 441/35, 40, 136
See application file for complete search history.

(56) References Cited

U.S. PATENT DOCUMENTS

| | | | | |
|---|---|---|---|---|
| 6,171,160 | B1 | 1/2001 | Skaggs et al. | |
| 6,976,434 | B2 | 12/2005 | Roig et al. | |
| 7,344,138 | B2 | 3/2008 | Romney | |
| D592,268 | S | 5/2009 | Montagnino | |
| 8,056,494 | B1 * | 11/2011 | Shalley | B63B 29/06 114/346 |
| D663,364 | S | 7/2012 | Allmandinger | |
| D740,373 | S | 10/2015 | Martin | |
| 2006/0080872 | A1 * | 4/2006 | Yeh | A47G 33/06 40/427 |
| 2008/0265510 | A1 * | 10/2008 | Howland | A63F 3/00533 273/309 |
| 2013/0323992 | A1 * | 12/2013 | Berenson | B63B 34/52 441/130 |

* cited by examiner

*Primary Examiner* — Daniel V Venne

(57) ABSTRACT

A stabilized flotation platform that is used for supporting supplies for those enjoying time in the water. The uniqueness is the stability provided by its construction such that materials contained on or in the device do not spill into the water.

9 Claims, 6 Drawing Sheets

STABILIZED FLOTATION PLATFORM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The instant invention deals with a stabilized flotation platform that is used for supporting supplies for those enjoying the water. The uniqueness of the instant invention is the stability provided by its construction such that materials contained on or in the device do not spill into the water.

There are many devices manufactured from foam that are used in and around water. For example, there is the well-known noodle that is an elongated, usually round in construction foam object, that is used by children for floating in water.

Knee boards, tables, surfing boards and even water skis are also manufactured for water use.

In U.S. Pat. No. 6,171,160 that issued Jan. 9, 2001, to Skaggs, et al there is shown a floating device which is a table that has unitary structure and is useful in water or on land, having a weighted base and a water-draining top surface. The weighted base is required in order to stabilize the device.

U.S. Pat. No. 6,976,434 that issued Dec. 20, 2005, to Roig, et al deals with a floating amphibious game table. The game table floats but is stabilized by legs and can be used on water or on land.

U.S. Pat. No. 7,344,138 that issued on Mar. 18, 2008, to Romney deals with a floating poker pad that is used on land and on water. It is not described how the pad is stabilized in water. Apparently, the pad is large and is hollow, both of which lead to its stability in water.

U.S. D592,268S that issued on May 12, 2009, to Montagnino deals with an ornamental design for a floating picnic table.

U.S. D663,364 S that issued on Jul. 10, 2012, deals with a floating table. There is no detail on stability of the device in water. The same situation abides with the design shown in U.S. D740,373 that issued Oct. 6, 2016, to Martin.

BRIEF SUMMARY OF THE INVENTION

Thus, there is disclosed and claimed herein a stabilized floating platform. The platform comprises a center platform manufactured from an inflatable material and having an outside wall and an inflatable material ring attached-to and encircling the outside wall. The inflatable material ring has a buoyancy greater than the center platform inflatable material and the center platform has a plurality of through holes for holding liquid containers. There is a large opening in the center platform for holding a large container.

DETAILED DESCRIPTION OF THE INVENTION AND DRAWINGS

Figure 1:
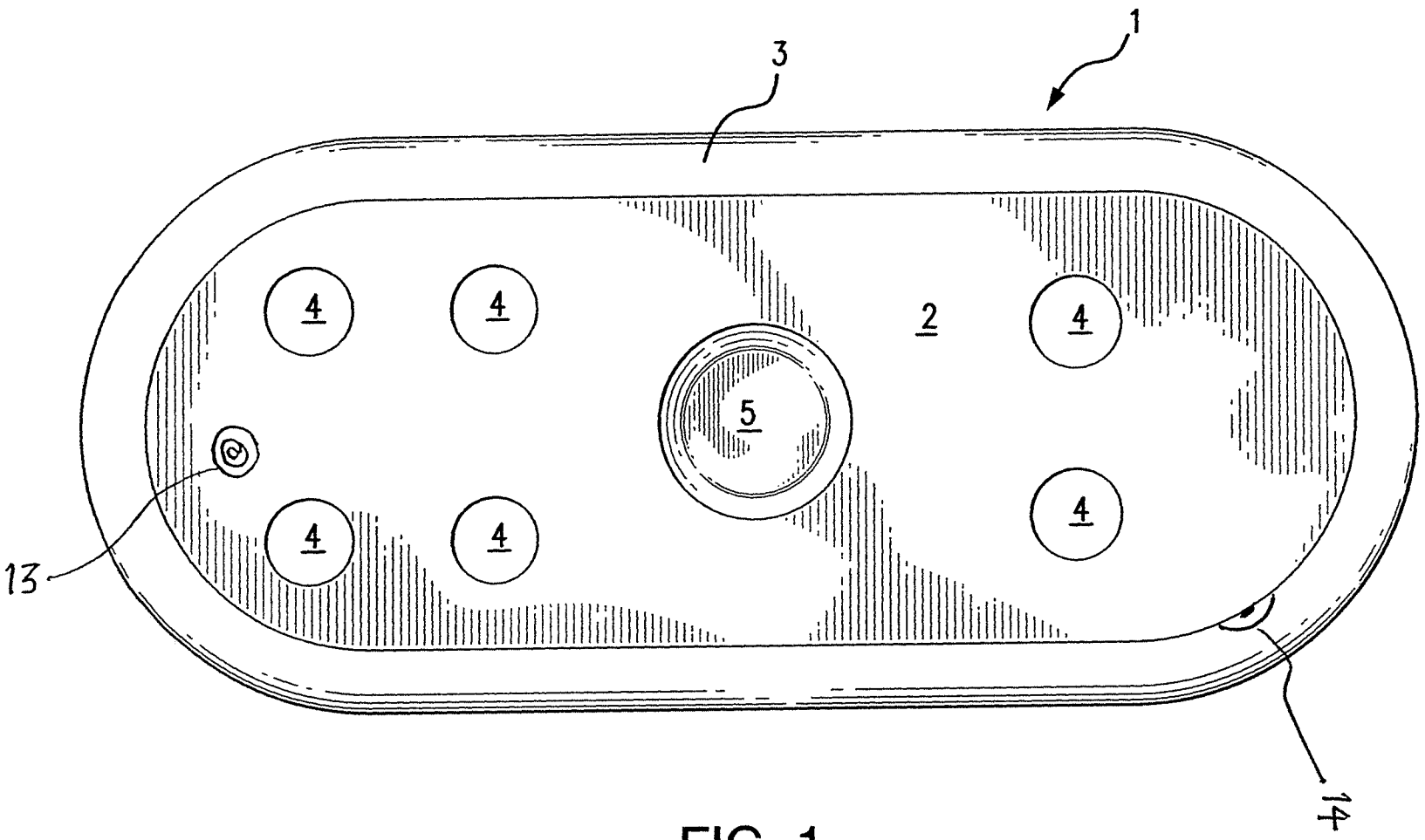
FIG. 1 is a full top view of the device of this invention showing the various openings.

FIG. 1 shows a full top view of a stabilized floating platform 1 of this invention showing a center inflatable material platform 2, and an attached inflatable material ring 3 encircling the center inflatable material platform 2. The inflatable material ring 3 has a buoyancy higher than the buoyancy of the center inflatable material platform 2. The device 1 of this invention is stabilized in water, meaning for purposes of this invention, that because of this differentiation in the two buoyancies, the inflatable material ring has a greater resistance to tipping over in water and stabilizes the entire device 1.

Figure 2:
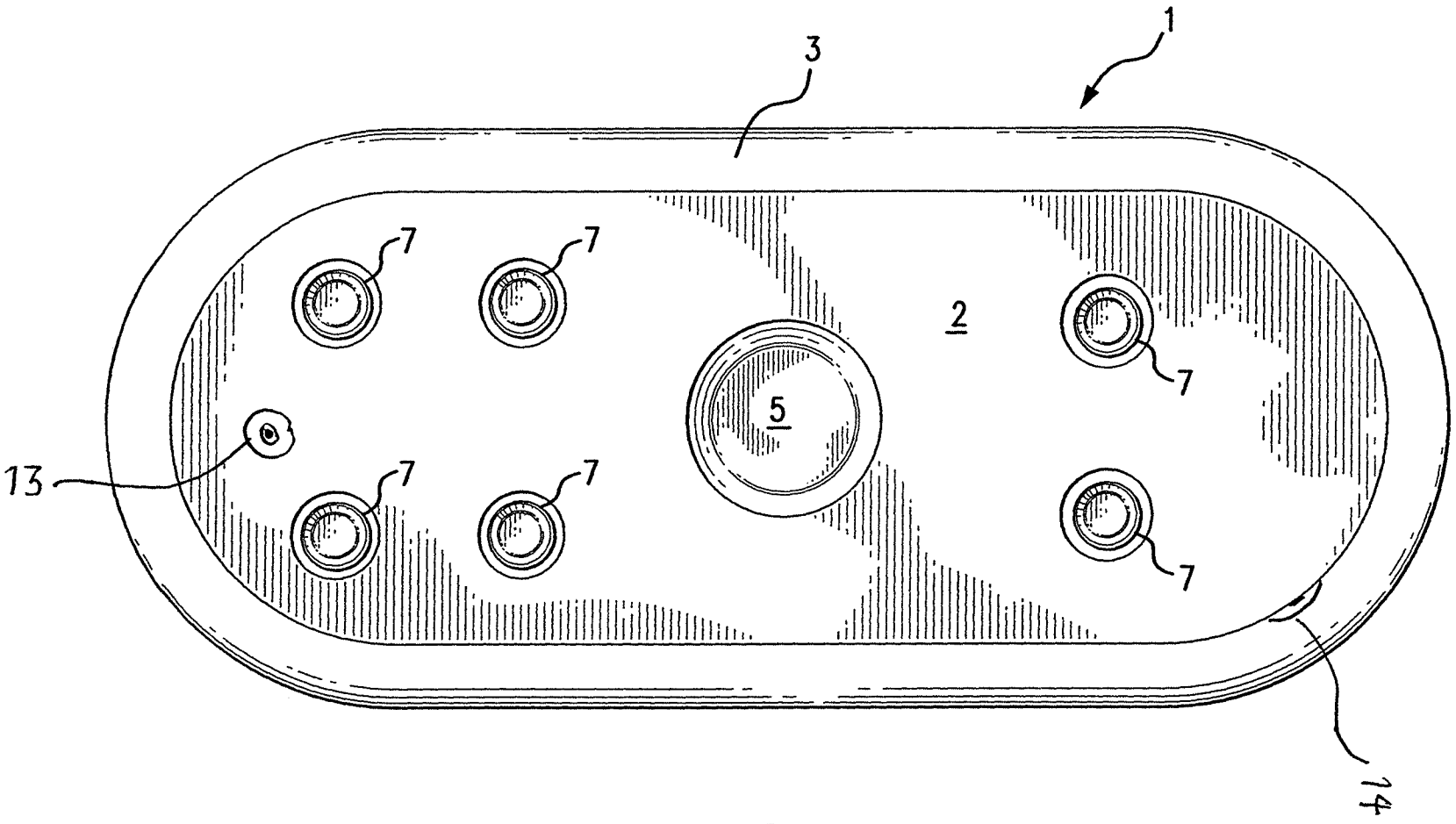
FIG. 2 is a full top view of the device of this invention showing the through holes filled with drink containers.

The center platform 2 has a plurality of holes 4 through it which serve as liquid container holders 7. FIG. 2 is a full top view of the stabilized floating platform with cups 7 in the openings 4. In addition, the center platform 2 has a large center opening 5 to hold large containers 8. By "large", for purposes of this invention, it is meant that this opening 5 is 6 to 14 inches in diameter and will hold an ice bucket or the like (See FIG. 4). Also, this opening 5 can hold containers of beverages, such as iced tea or the like. The through openings 4 have a diameter ranging from about 2 inches to about 5 inches.

Figure 3A:
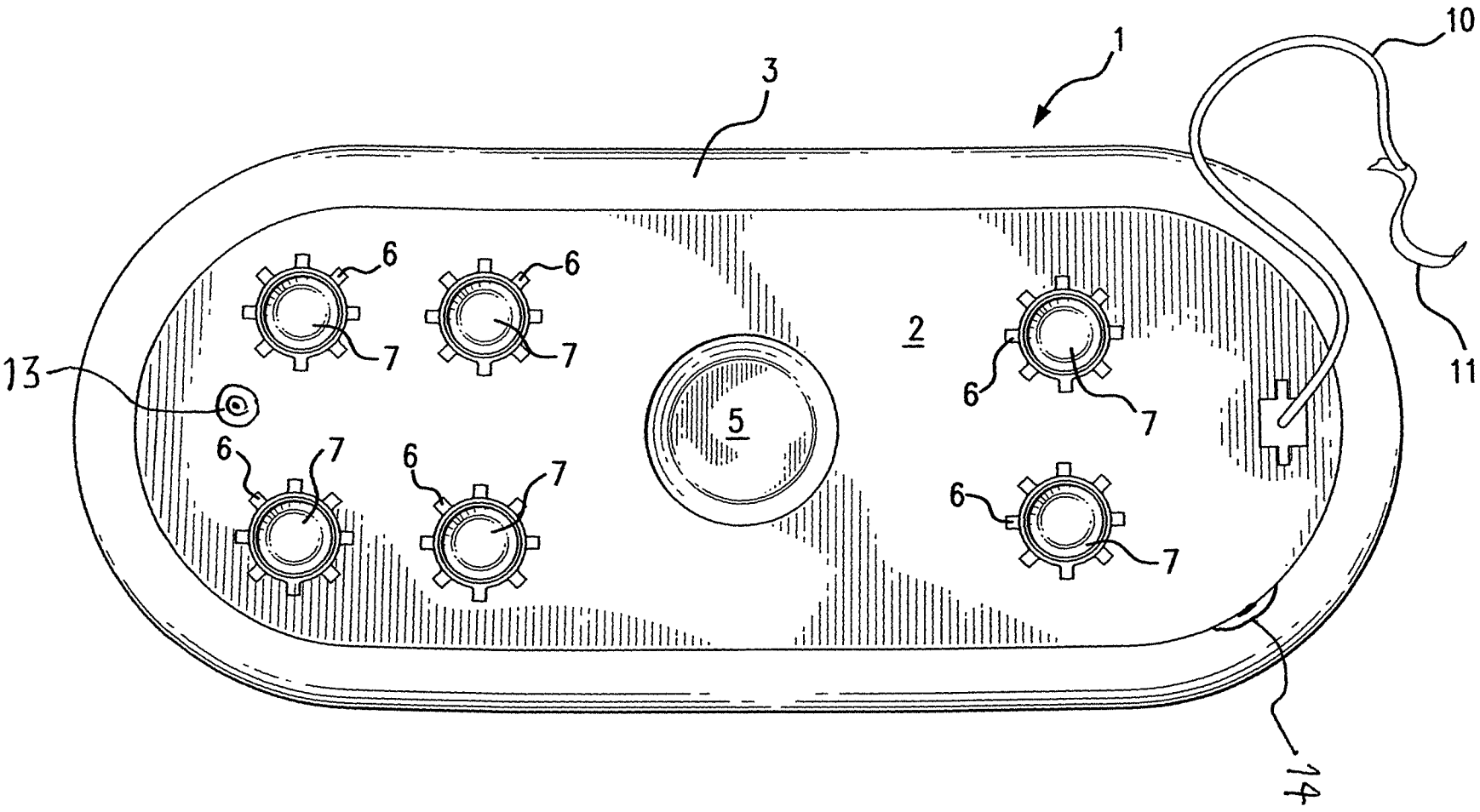
FIG. 3A is a full top view of a device of this invention showing the tumbler rings and tether.
Figure 3C:
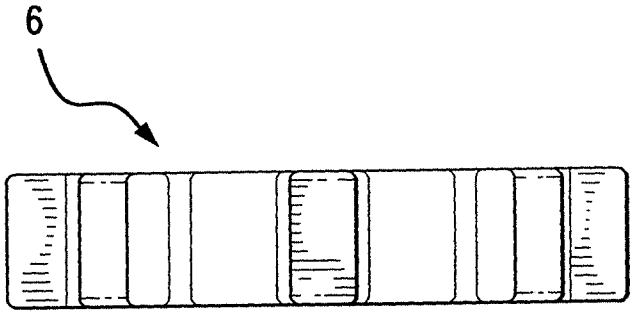
FIG. 3C is a full side view of a tumbler ring of this invention.
Figure 3B:
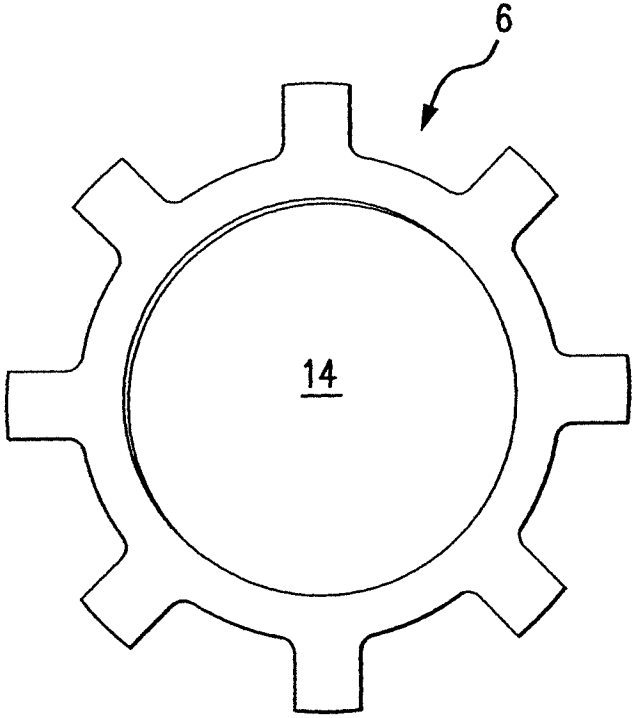
FIG. 3B is a full top view of a tumbler ring of this invention.

Some beverage containers are larger than the normal glass beverage containers and therefore, the openings 4 can have an auxiliary supporting member called a tumbler ring 6 as shown on FIGS. 3A, 3B, and 3C. FIG. 3B shows the opening 14 in the center of the tumbler ring. Surrounding the beverage container, and being larger in diameter than the beverage container, the tumbler ring 6 stabilizes the beverage container from tipping over.

Figure 4:
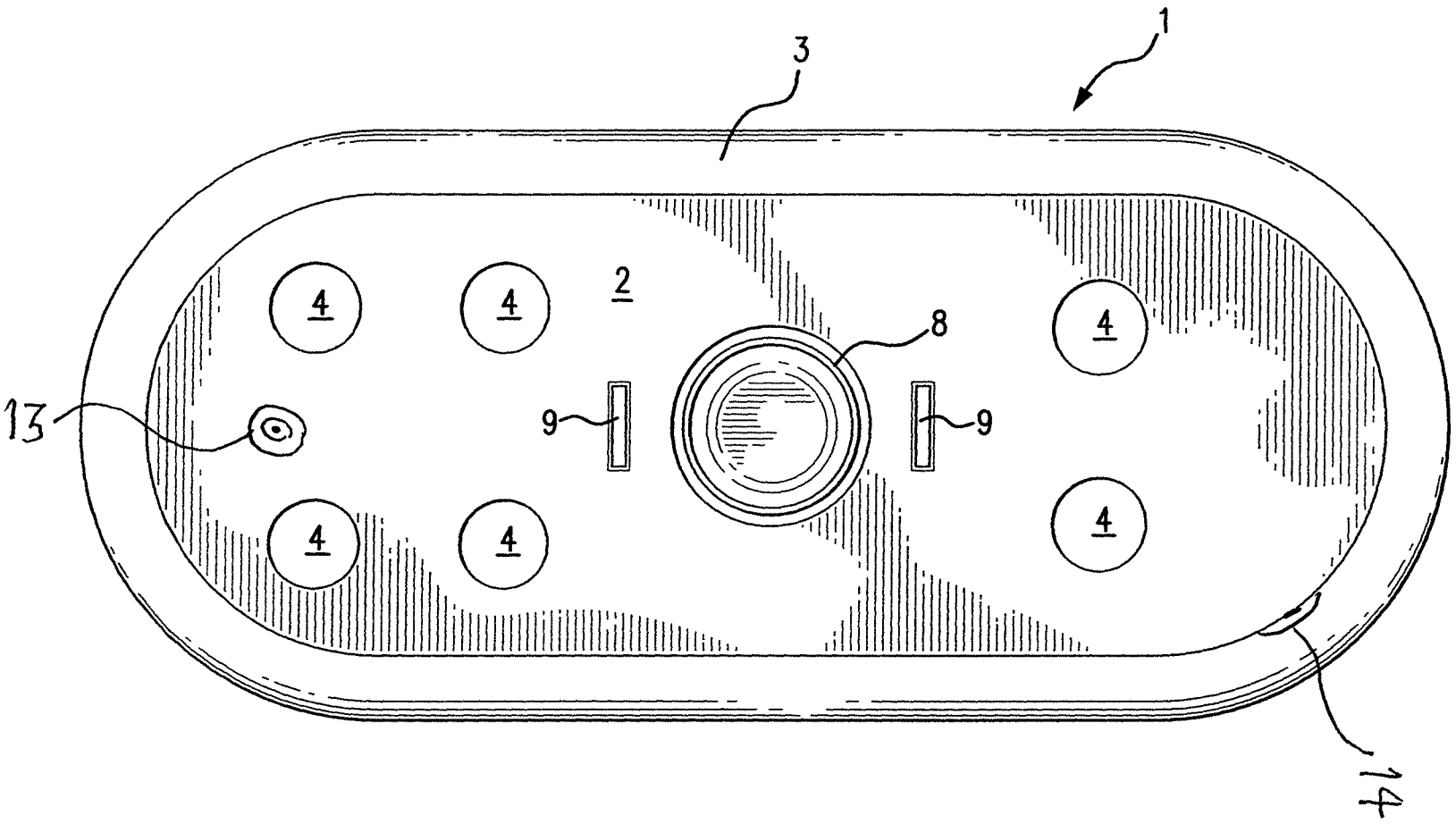
FIG. 4 is full top view of a device of this invention showing a large container in the large opening and auxiliary configurations in the center platform foam.

FIG. 4 also shows auxiliary component formations (slots or indentions) 9 for holding, for example, telephones, or other electronic devices, or other auxiliary components such as sun cream containers.

The stabilized floating platform 1 can also have a tether 10 attached to it to allow a person to maintain the platform 1 in a nearby vicinity. One means of attaching the tether to the person is an arm or leg band 11 which can close using Velcro® or something similar.

Figure 5:
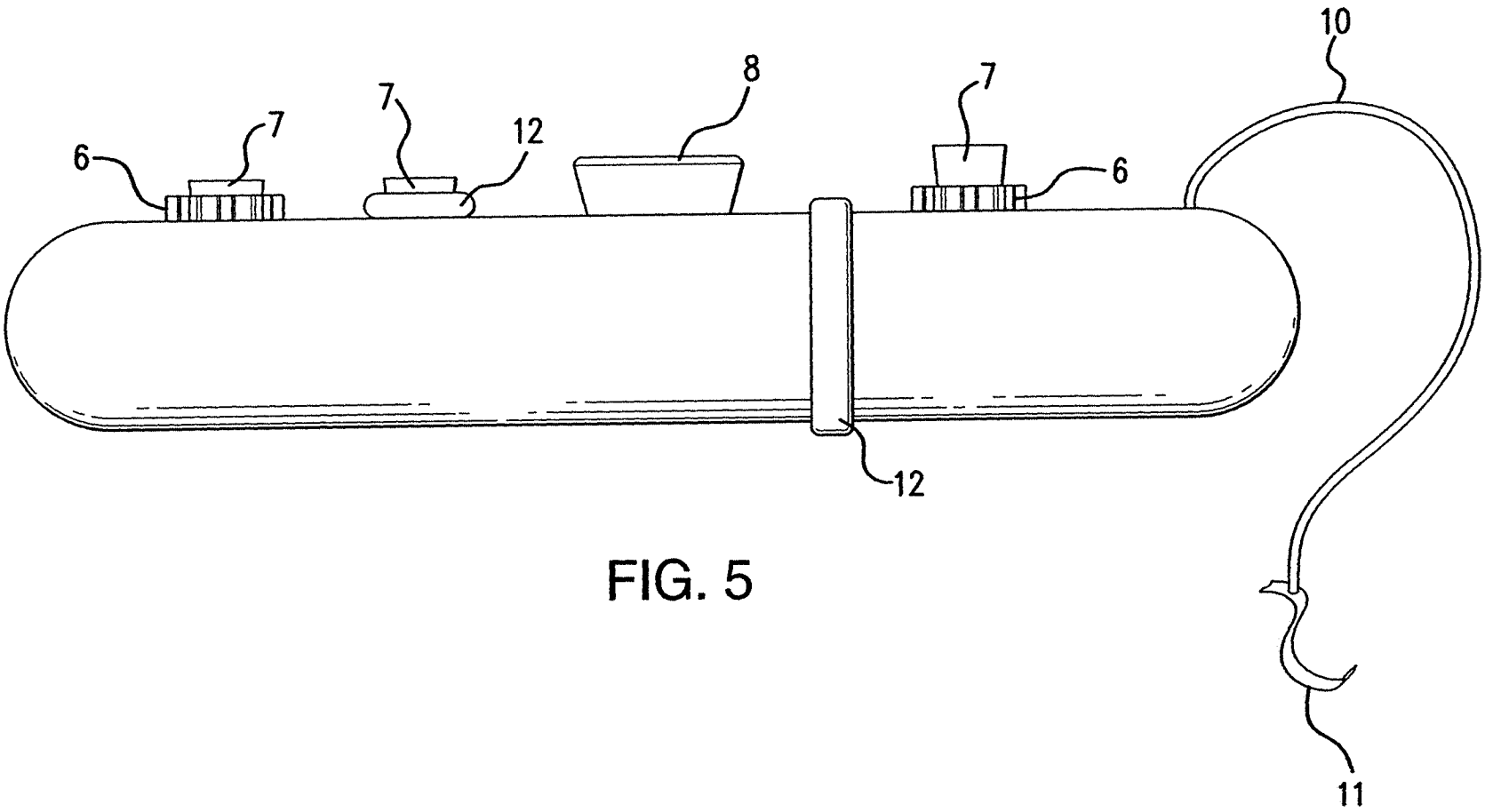
FIG. 5 is a full side view of a device of this invention.

FIG. 5 is a full side view of the platform 1 of this invention showing the inflatable material ring 3, liquid containers 7, an ice bucket 8, tumbler rings 6, a tether 10, with arm band 11, and light reflectors 12 (See FIG. 5).

The stabilized floating platform 1 has a nominal size ranging from about 2 feet to 6 feet long, about 14 to 28 inches wide with the encircling inflatable material ring 3 having a diameter ranging from about 3 inches to about 8 inches. The center platform 2 thickness ranges from about 2 inches to about 6 inches.

The center platform 2 is manufactured from inflatable material. The platform 2 has a valve 13 for this purpose and the ring 3 has a similar valve 14 for this purpose (See Figures For this inventive device, one just has to be sure that the buoyancy of the ring 3 is higher than the buoyancy of the center platform 2 to ensure stability of the device in water.

The inflatable material useful in this invention can be plastic or like material, just as long as the material will hold introduced air. The plastic can be patterned in any desired pattern.

What is claimed is:

1. A stabilized floating platform, comprising:

I) a center platform manufactured from an inflatable material and having an outside wall;

II) an inflatable material ring attached to, and encircling said outside wall, said inflatable material having a buoyancy greater than said center platform inflatable material;

III) said center platform having a plurality of through holes for holding drink containers;

IV) a through opening in said center platform for holding a container

V) wherein the stabilized floating platform is manufactured from plastic.

2. A stabilized floating platform as claimed in claim 1 wherein there is a tether attached to said stabilized floating platform.

3. A stabilized floating platform as claimed in claim 1 wherein each said plurality of through holes has a tumbler ring inserted in them.

4. A stabilized floating platform as claimed in claim 3 wherein the tumbler rings are manufactured from foamed plastic.

5. A stabilized floating platform as claimed in claim 1 wherein the container is manufactured from foamed plastic.

6. A stabilized floating platform as claimed in claim 1 wherein at least one light reflector is attached to said stabilized floating platform.

7. A stabilized floating platform as claimed in claim 1 wherein the stabilized floating platform and components are manufactured from white inflatable material.

8. A stabilized floating platform as claimed in claim 1 wherein the stabilized floating platform and components are manufactured from colored inflatable material.

9. A stabilized floating platform as claimed in claim 1 wherein the stabilized floating platform has formations therein to accommodate hand-held electronic devices.

* * * * *